United States Patent [19]

John, Jr.

[11] 4,134,716

[45] Jan. 16, 1979

[54] PRESS APPARATUS

[75] Inventor: Clarence D. John, Jr., Penn Hills, Pa.

[73] Assignee: Westinghouse Electric Corp., Pittsburgh, Pa.

[21] Appl. No.: 836,175

[22] Filed: Sep. 23, 1977

[51] Int. Cl.[2] ..... B30B 15/04

[52] U.S. Cl. ..... 425/186; 425/193; 425/78; 425/411; 425/352

[58] Field of Search ..... 425/186, 193, 411, 78

[56] References Cited

U.S. PATENT DOCUMENTS

| | | | |
|---|---|---|---|
| 2,115,246 | 4/1938 | Bainbridge | 425/186 |
| 2,386,641 | 10/1945 | Trockle et al. | 425/193 |
| 3,559,238 | 2/1971 | Gilman | 425/186 X |
| 3,792,947 | 2/1974 | Diehl | 425/193 X |

*Primary Examiner*—J. Howard Flint, Jr.
*Attorney, Agent, or Firm*—Edward L. Levine; Z. L. Dermer

[57] ABSTRACT

A punch press remotely disengageable from the punch drive mechanism, particularly useful where the press must operate in a hostile environment. The press includes a punch block, supporting one or more punches, which is laterally inserted into connection with the punch drive apparatus. A die set is provided for supporting one or more dies, and the die set is associated with the punch block such that the punch is guided into a preselected position relative to the die by the drive apparatus. A structural frame is provided for seating the die set, which can be laterally inserted and removed from the frame. Guide rails are also provided which can extend laterally from the frame and support the die set in a position removed from the normal operating position within the frame. The guide rails also support the die set in the operating position. An hydraulic cylinder can also be provided to laterally eject the guide rails and die set, and the punch block and punch from the frame area, thereby exposing the components for removal.

5 Claims, 4 Drawing Figures

PRESS APPARATUS

BACKGROUND OF THE INVENTION

1. Field of the Invention

This invention relates to press apparatus, and particularly provides an arrangement for remotely changing the die and punch of a press.

2. Description of the Prior Art

In the processing of nuclear fuel, a press is typically utilized for forming fuel pellets from a powdered or granulated mixture into solid cylindrical pellets. Because of the radioactivity and desired safety characteristics, the press typically operates within a hostile environment. Accordingly, in order to change dies and punches, as well as to maintain and repair the press as periodically necessary, the press is typically sealed within a hostile environment.

In the past, the press has typically been placed in a sealed area through which maintenance can be performed by glove box operations. An improved arrangement for an integrated nuclear fuel processing system is described in copending application Ser. No. 828,059, which is a continuation of abandoned application Ser. No. 765,485, filed Feb. 4, 1977, entitled "Remote Nuclear Green Pellet Processing System". An improved arrangement for safely enclosing in a hostile environment a press of the type disclosed herein is taught in an application entitled "Press Apparatus Enclosure Arrangement", filed herewith in the name of C. D. John, Jr. Ser. No. 836,174. The integrated system includes a gravity feed and a stepped orientation among various components in the process which allow for maintenance operations through the walls of the stepped room enclosing the hostile environment.

It is further desirable, however, to provide a press in which the punch and die tooling can be easily changed in a remote fashion.

SUMMARY OF THE INVENTION

This invention provides press apparatus which enables remote changing of the punch and die tooling in a simplified fashion. The press includes a punch drive apparatus from which a punch block suporting a punch is disengageable when moved in a lateral direction. A die set for supporting a die is affixed to structure which guides the punch into a preselected position with respect to the die under the influence of a reciprocating force applied by the drive apparatus. A frame is provided which slidably receives and supports the die set and affixed components as they are slidably inserted into operating position in the frame through a lateral motion. Guide rails are also provided which can extend from the frame in a lateral direction so as to support an assembly including the die set and die, guide structure and punch block and punch when they are laterally removed from the press.

In this laterally extended position, the structure is easily accessible by removing means, such as an overhead crane, which lifts the assembly off of the extended guide rails in a singular operation. A similar structure, having different dies and punches, can then be inserted onto the guide rails. By remotely sliding these replacement components into place, the tooling exchange has transpired in a remote and simplified fashion. Further, since the punch and die, and the structure guiding the punch relative to the die, has been replaced in one operation, the alignment of the punch and die is assured as being proper.

The laterally sliding operation can be performed by a hydraulically driven cylinder in a remote fashion. And, upon insertion of the replacement punch block and die set, the inserted apparatus can be locked in place.

BRIEF DESCRIPTION OF THE DRAWINGS

The advantages, nature and additional features of the invention will become more apparent from the following description, taken in connection with the accompanying drawings, in which.

DESCRIPTION OF THE PREFERRED EMBODIMENT

Figure 1:
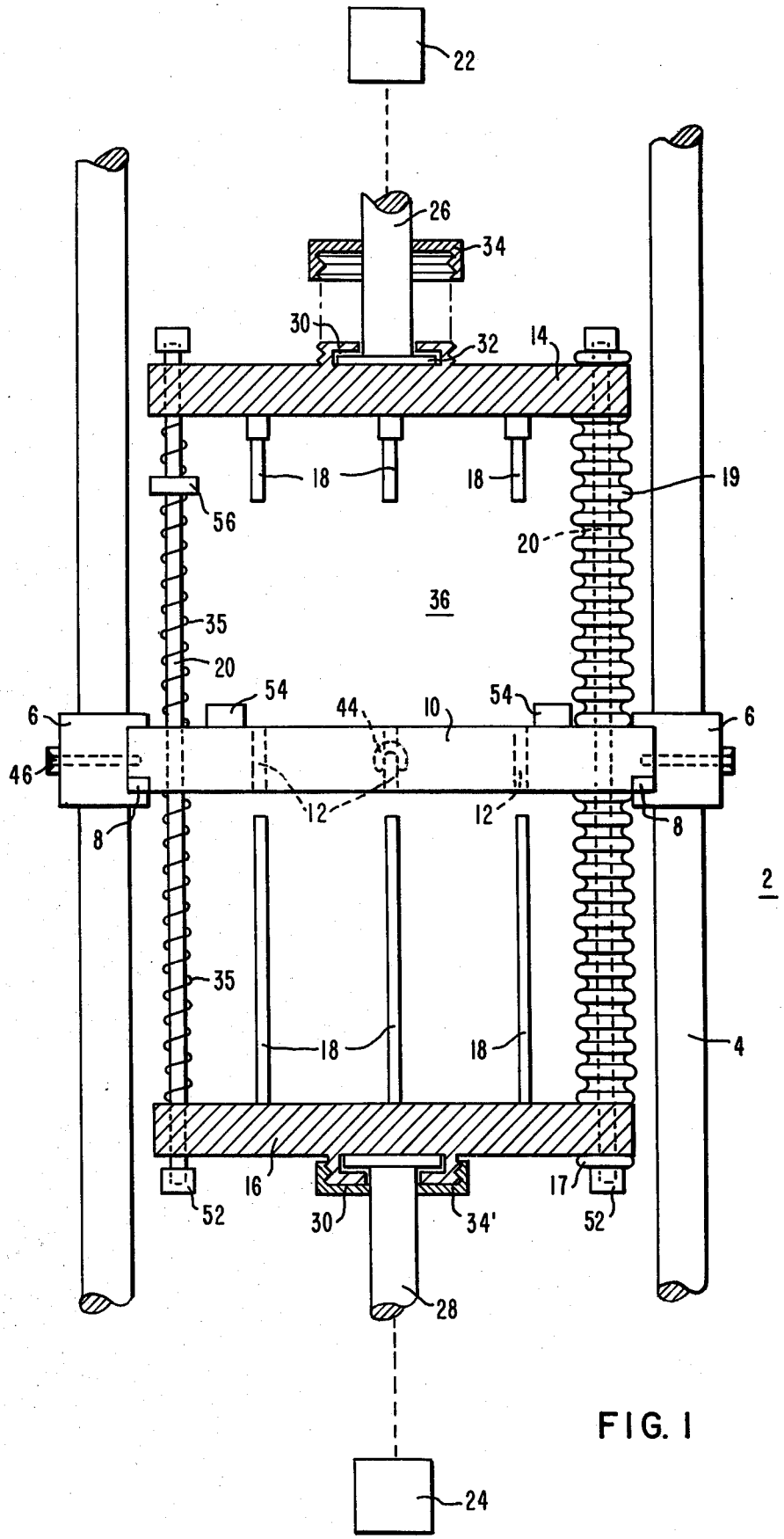
FIG. 1 is a front view, in elevation, of press apparatus in accordance with this invention.

Referring now to FIG. 1 there is shown a punch press 2 including a structural support frame 4. Affixed to the frame 4 are guides 6 having means for slidably receiving a die set 10, insertable into the guides 6. The frame 4 includes means for supporting the die set 10, such as the guide rails 8. Although the die set 10 can include a singular die 12, preferably a plurality of dies 12 are utilized.

In accordance with the invention and the method of use of the press 2, a singular or dual punch block system can be utilized. In the preferred embodiment shown in FIG. 1 an upper punch block 14 and a lower punch block 16 are both included. The punch blocks 14, 16 each include punches 18, matingly sized to the dies 12. To maintain alignment among the punch blocks 14, 16 and the die set 10, guide bars 20 are affixed to the die set 10. The bars 20 additionally guide the rams and punches into a preselected position with respect to the dies during press operation. The force necessary to reciprocatingly drive the punch blocks into and out of the preselected position is provided by upper 22 and lower 24 drive means. The drive means can include hydraulic, pneumatic, mechanical, or electrically driven systems, among others, although hydraulics are preferred to provide a system which is relatively compact and which has a high degree of control with respect to the pressure and stroke distance applied. The guide bars 20 are desirably provided with collapsible covering means, such as the bellows 17, 19 (shown on the right side only in FIG. 1), to avoid a buildup of material on the guide bars 20 which could affect the sliding motion of the punch blocks 14, 16 on the bars 20.

The punch blocks 14, 16 are slidably engageable with upper 26 and lower 28 drive shafts which transmit the drive force from the drive means 22, 24 to the punches 14, 16. Although varying geometric configurations can be utilized, a preferred T-slot 30 type engagement is shown in FIG. 1, and in additional detail in FIG. 4. As shown, a drive shaft extension 32 can be laterally and slidably inserted into and retracted from the slot 30. If desired, a ram nut 34 or other suitable locking means locks the drive shaft 26, 28 into the engaged position. Upper ram nut 34 is shown in an unlocked retracted position, and lower ram nut 34' in a locked orientation.

Although the sliding enagement described is preferred, the drive shafts 26, 28 need not be affixed to the punch blocks 14, 16. Alternatively, the shafts can merely be positionable into contact with the punch blocks, so as to drive the blocks toward the die set, and a return means, such as a flexible spring 35 (shown on the left side only in FIG. 1), can subsequently drive the punch blocks away from the die set. The drive means would also return the drive shafts to a selected position removed from the die set, as shown.

Figure 2:
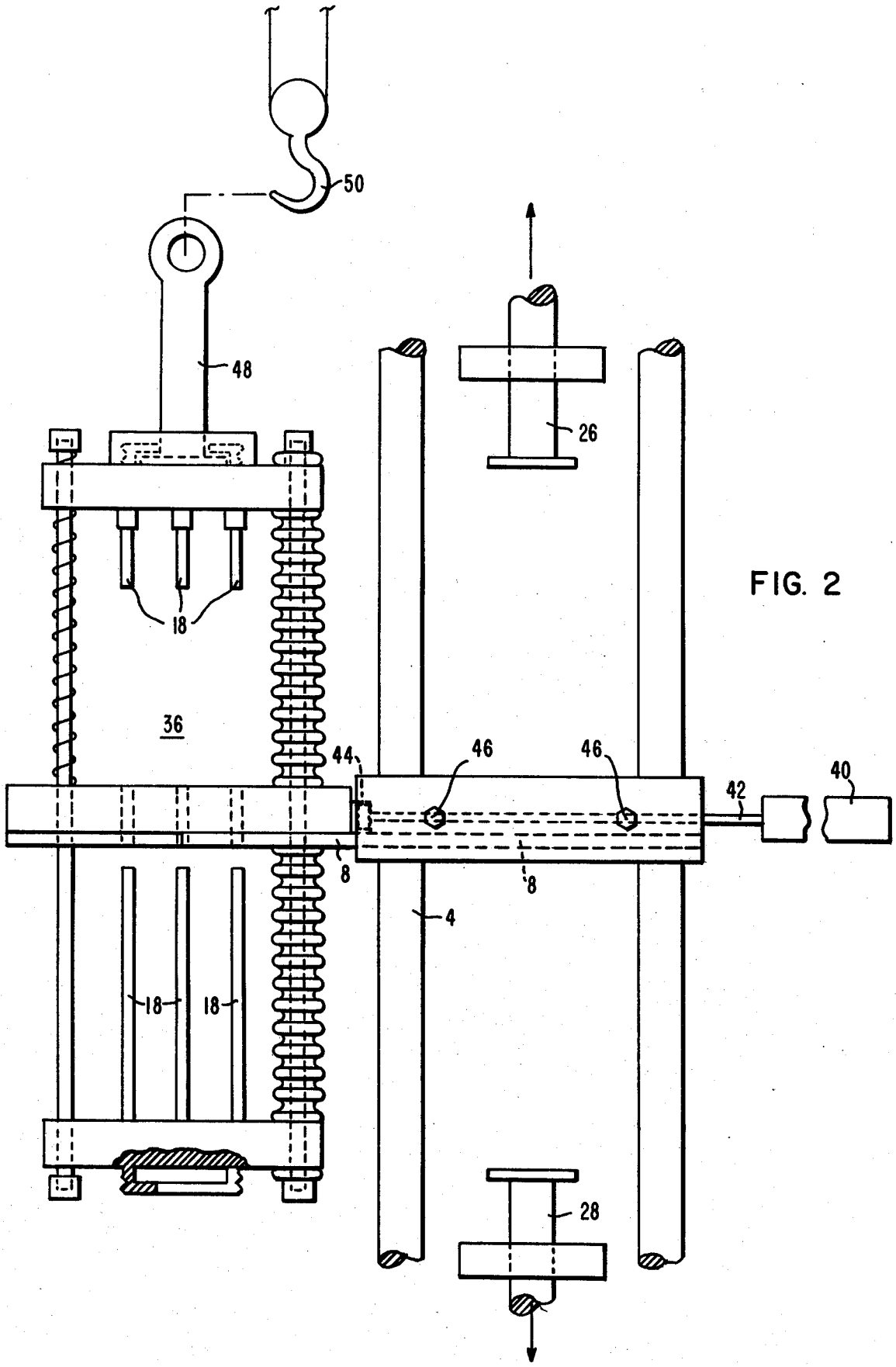
FIGS. 2 and 3 are side views, in elevation, showing the apparatus of FIG. 1 respectively in the extended and operating positions.
Figure 3:
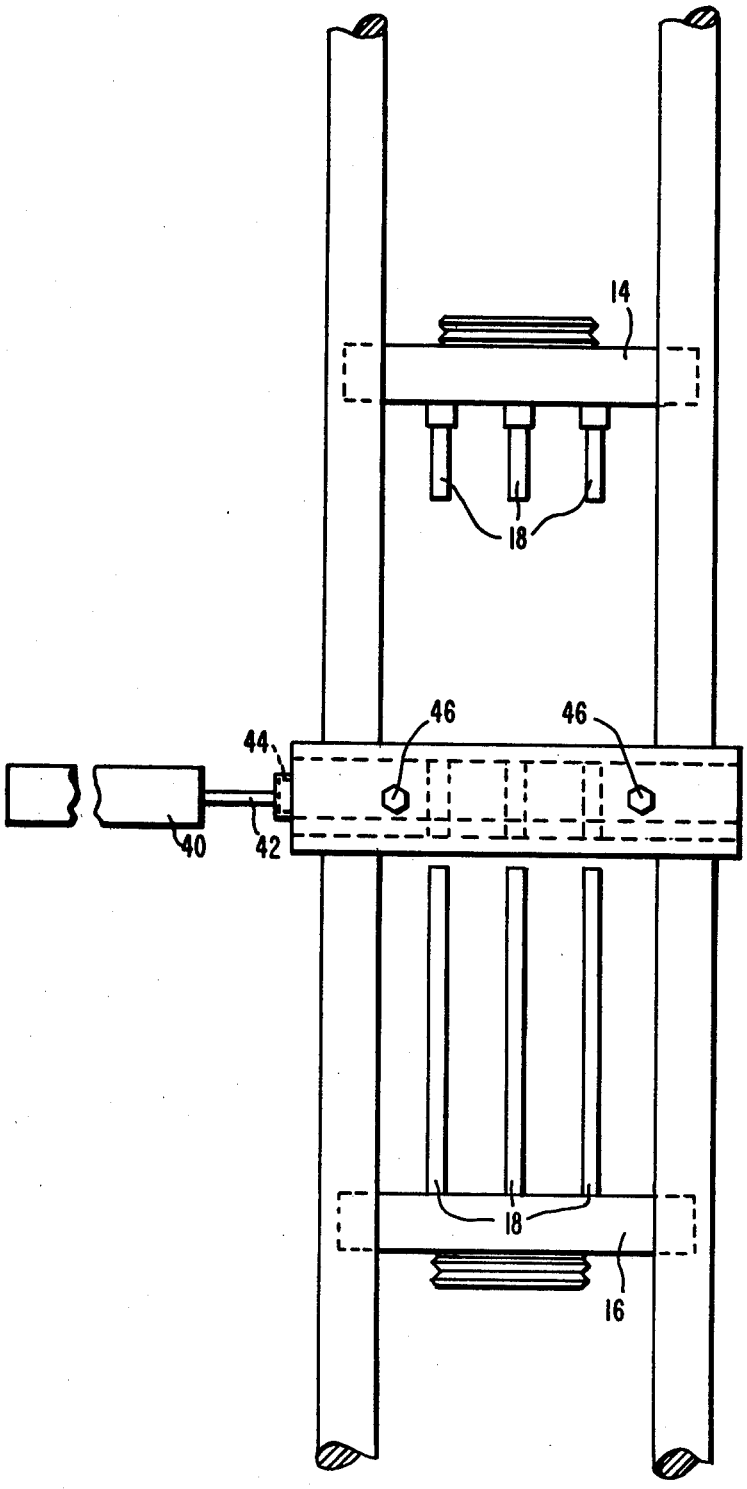
Figure 4:
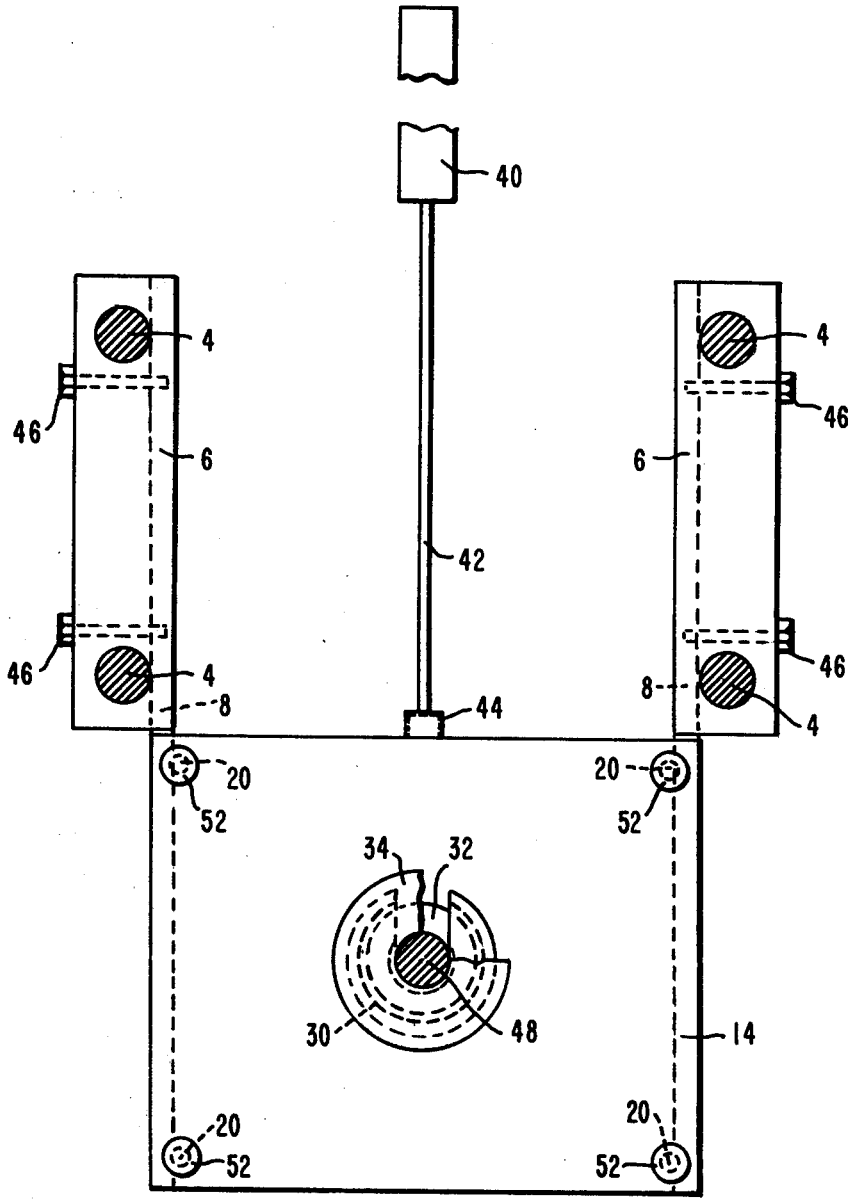
FIG. 4 is a top plan view of the apparatus of FIG. 1.

From the structure thus described, it can be seen that the entire assembly 36 including the die set 10, upper 14 and lower 16 punch blocks and punches 18 and guide bars 20 can be laterally moved into or out of the support frame 4 in a singular operation. In order to support the assembly 36 in a position laterally extended from the frame 20, shown best in FIG. 2, the guide rails 8 are utilized. The guide rails 8 are supported in a lateral orientation within the frame 4 in the operating position (FIGS. 1 and 3), and extend outwardly for insertion or removal of the assembly 36 (FIGS. 2 and 4). The guide rails 8 can slide relative to the frame through the use of bearings, rollers, or slotted engagements, among other guide and support means.

The assembly 36 and guide rails 8 can be laterally moved by moving means such as an eject cylinder 40. The cylinder 40 can be hydraulically or otherwise driven, remotely, and includes an extension 42 which is removably coupled to the assembly 36 by attaching means such as the receiver slot 44. Upon activation of the cylinder to laterally move the die set and the assembly 36, the guide rails 8 move laterally to a position partially extended from the frame. The guide rails include a stop or keyed apparatus, or other support and guide means, to limit the amount of lateral extension and to maintain the rails supported within the frame. As shown best in FIG. 3, prior to lateral extension of the assembly 36 from the frame 4, latch means such as the locking bolts 46 which affix and register the die set 10 in the guides 6, must be loosened. It will be apparent that the press apparatus described is ideally adaptable to operations requiring remote changing of the punch and die tooling, for example, where the apparatus must operate on a hostile material or within a hostile environment. This is particularly useful in a facility for fabrication of mixed oxide or other nuclear fuel, in which granulated fuel is remotely fed to the press apparatus for fabrication into substantially cylindrical fuel pellets. In such systems, it is periodically necessary to change the punch and die tooling, and manual access through glove ports located near the equipment is limited. In the disclosed system the entire assembly 36 can easily be replaced by providing lifting means, such an an electromagnet, quickcoupling device, or the lift adaptor 48 coupled with an overhead crane hook 50, among others.

Although upward removal of the assembly 36 from the guide rails 8 is preferred, other configurations can be utilized. The assembly 36 can also be removed and replaced by use of a conveyor device which laterally moves it from the guide rails, or which lowers it onto, for example, a movable cart or conveyor. In any of the arrangements, however, the removal sequence is relatively easy since the entire assembly is moved in one operation.

The specific sequence of operation to remotely change the tooling is relatively simple. Subsequent to removal of any necessary accessory equipment, such as the apparatus for inserting a powder into the dies, the punch blocks 14, 16 are moved to a preselected uncoupling position and fixed in place. The lower punch block 16 may be fixed by seating upon supports 52 (FIG. 1) affixed to the guide bars 20, and the upper punch block 14 can be seated upon an insert 54 placed between the punch block 14 and die set 10 or other positioning means such as clamps 56 positioned by use of glove ports onto the guide bars 20. Subsequently, the ram nuts 34 are loosened and retracted and the locking bolts 46 are also retracted. The assembly 36 is now free to slide laterally from the frame. The eject cylinder 40 is actuated so as to push the assembly 36 and guide rails 38 from the frame 4. As the assembly moves outward, the guide rails 38 move partially out of the frame 4 to support the assembly. The crane hook 50 or other removal means can then be lowered and attached to the assembly, so as to lift it up and away from the guide rails. As the assembly is removed, the extension 42 is slidingly disengaged from the receiving slot 44.

The crane can then return a replacement assembly 36 onto the extended guide rails. The process is then reversed, and sequentially includes uncoupling the crane, positioning the drive shafts 26, 28, retracting the eject cylinder, assembly and guide rails, positioning the ram nuts and locking bolts, removing the clamps, and replacing any accessory equipment.

It will be readily observed by one skilled in the art that although the invention has been described with reference to a substantially vertical orientation of the press apparatus, the invention can advantageously be utilized in a horizontal or other orientation. The drive shafts would remain laterally insertable into the punch blocks, but the location of the guide rails would require different positioning so as to support the die set through its sides. The side of the die set could also be provided with a removably coupled lifting lug, for attachment to a crane or other removal device.

It will therefore be apparent that the described invention provides a simplified system for changing punch and die tooling which can be utilized remotely. It will be apparent that many modifications and additions are possible in view of the above teachings. It therefore is to be understood that within the scope of the appended claims, the invention may be practiced other than as specifically described.

I claim:

1. Press apparatus for forming nuclear fuel pellets comprising:

(a) a die set having means for receiving nuclear fuel powder;

(b) a frame having means for slidably receiving and supporting said die set in an operating position;

(c) drive apparatus spaced from said frame for applying a reciprocating force;

(d) a punch block cooperatively associated with a punch matingly sized to said fuel powder receiving means so as to compress said powder into a nuclear fuel pellet, said punch block being slidingly engageable with said drive apparatus;

(e) means engageable with said die set and punch block for reciprocatingly guiding said punch into a preselected position with respect to said fuel powder receiving means in response to said reciprocating force being applied to said punch block; and (f) means extendable from said frame for supporting in a position extended outwardly from said frame, said die set, punch block and guiding means such that upon slidingly disengaging said die set from said receiving and supporting means said punch block is slidingly disengaged from said drive apparatus, and such that said die set, punch block and guiding means are supported in said position extended from said frame.

2. The press of claim 1 wherein said extendable means comprise a plurality of guide rails sized and positioned to matingly receive and support said die set within said frame in said operating position and slidingly extendable outwardly from said frame to support said die set in said extended position.

3. The press of claim 1 wherein said punch block includes a plurality of apertures therethrough and wherein said guiding means comprise a plurality of guide bars, each sized to slidingly fit within one of said apertures, said guide bars each having a collapsible bellows surrounding at least a portion of said bar.

4. Press apparatus for forming nuclear fuel pellets comprising:

(a) a frame removably supporting a die set having an opening therein for receiving nuclear fuel power;

(b) punch blocks disposed on opposite sides of said die set each having a punch matingly sized to said opening, said blocks each being removably connectable to drive means for reciprocatingly moving said blocks in relation to said die set;

(c) means cooperatively associated with said punch blocks and die set for guiding said blocks into said relation with said die set; and (d) means on said frame for supporting said die set in an operating position, said means further being extendable from said frame for supporting said die set, punch blocks and guide means in a position extended outwardly from said frame upon disconnection of said punch blocks from said drive means.

5. In combination with a nuclear fuel pellet forming a press of the type wherein support structure supports a die set and a vertical drive shaft is reciprocatingly driven toward said die set, the improvement which comprises:

(a) movable means affixed to said support structure for supporting said die set in an operating position aligned with the axis of said shaft and for supporting said die set in a replacement position laterally disaligned with said axis;

(b) a punch block cooperatively associated with a punch, said block being laterally positionable into said operating position in engagement with said drive shaft;

(c) vertically oriented means movable with said die set for slidingly guiding said punch block and punch into a selected position with respect to said die set upon a force applied by said drive shaft; and (d) means for maintaining said punch block affixed to said guiding means upon movement of said guiding means;

whereby upon lateral movement of said movable support means to said replacement position, said die set, punch block and punch, and guide means are integrally moved to a position laterally disaligned with said axis.

* * * * *